US010186753B2

(12) United States Patent
Asou et al.

(10) Patent No.: US 10,186,753 B2
(45) Date of Patent: Jan. 22, 2019

(54) ANTENNA DEVICE AND PORTABLE ELECTRONIC DEVICE USING THE SAME

(71) Applicant: TDK CORPORATION, Tokyo (JP)

(72) Inventors: Hirohumi Asou, Tokyo (JP); Toshifumi Komachi, Tokyo (JP); Toshio Tomonari, Tokyo (JP); Yoshitomo Sato, Tokyo (JP); Kosuke Kunitsuka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 297 days.

(21) Appl. No.: 14/606,378

(22) Filed: Jan. 27, 2015

(65) Prior Publication Data

US 2015/0222009 A1 Aug. 6, 2015

(30) Foreign Application Priority Data

Jan. 31, 2014 (JP) ..... 2014-017086
Jan. 31, 2014 (JP) ..... 2014-017087

(51) Int. Cl.

*H01Q 1/24* (2006.01)
*H01Q 7/00* (2006.01)
*H01Q 1/38* (2006.01)
*H01Q 13/10* (2006.01)

(52) U.S. Cl.

CPC ..... *H01Q 1/243* (2013.01); *H01Q 1/38* (2013.01); *H01Q 7/00* (2013.01); *H01Q 13/10* (2013.01)

(58) Field of Classification Search

CPC ..... H01Q 1/38; H01Q 1/243; H01Q 1/52; H01Q 1/526; H01Q 7/00; H01Q 7/06

See application file for complete search history.

(56) References Cited

U.S. PATENT DOCUMENTS 5,945,954 A * 8/1999 Johnson ..... H01Q 9/0407 343/700 MS
2002/0053992 A1 5/2002 Kawakami et al.
2009/0201116 A1* 8/2009 Orihara ..... G06K 19/07749 336/200
2010/0123010 A1 5/2010 Sakama
2011/0287715 A1 11/2011 Matsuura et al.
2012/0262357 A1 10/2012 Kato et al.
2013/0307746 A1 11/2013 Nakano et al.

(Continued)

FOREIGN PATENT DOCUMENTS

CN 104682005 A 6/2015
JP 2001143037 A 5/2001

(Continued)

*Primary Examiner* — Jessica Han
*Assistant Examiner* — Jae Kim
(74) *Attorney, Agent, or Firm* — Young Law Firm, P.C.

(57) ABSTRACT

Disclosed herein is antenna device that includes: a first metal member having a first main surface; a second metal member having a second main surface parallel to the first main surface; and an antenna coil having a coil axis perpendicular to the first and second main surfaces, wherein the first metal member constitutes at least a part of a housing of a portable electronic device in which the antenna coil is mounted, at least one slit is formed between the first and second metal members, an inner diameter section of the antenna coil overlaps with the slit in planar view, and the slit has a constant width at least in a region that overlaps with the antenna coil in planar view.

7 Claims, 21 Drawing Sheets

(56) References Cited

U.S. PATENT DOCUMENTS

| | | | | |
|---|---|---|---|---|
| 2014/0198006 | A1* | 7/2014 | Nakano | G06K 19/07794 343/788 |
| 2014/0247188 | A1 | 9/2014 | Nakano et al. | |

FOREIGN PATENT DOCUMENTS

| | | |
|---|---|---|
| JP | 2002-111363 | 4/2002 |
| JP | 4687832 | 10/2010 |
| JP | 2013-162195 | 8/2013 |
| JP | 569810 B | 2/2015 |

* cited by examiner

ANTENNA DEVICE AND PORTABLE ELECTRONIC DEVICE USING THE SAME

BACKGROUND OF THE INVENTION

Field of the Invention

The present invention relates to an antenna device, and particularly to an antenna device that is suitable for NFC (Near Field Communication). The present invention also relates to a portable electronic device in which such an antenna device is mounted.

Description of Related Art

In recent years, in portable electronic devices such as smartphones, a system of RFID (Radio Frequency Identification) is mounted. As a communication means for the system, an antenna is mounted to perform near field communication with a reader/writer or the like.

Meanwhile, in the portable electronic device, in order to protect an internal circuit from external noise and prevent unnecessary radiation of noise generated inside the device, a metal shield is provided. In particular, in order to make the body thinner, lighter, and more resistant to shock such as when the body is dropped, and to improve the design and other factors, the housing of a recent portable electronic device itself has increasingly been made of metal instead of resin, with the housing doubling as a metal shield. However, in general, the metal shield blocks radio waves. When an antenna is provided, the antenna needs to be placed in such a way as not to overlap with the metal shield. If the metal shield is provided across a wide range, how to dispose the antenna becomes a problem.

To solve the above problem, for example, in an antenna device disclosed in Japanese Patent Application Laid-open No. 4,687,832, Japanese Patent Application Laid-Open No. 2002-111363, or Japanese Patent Application Laid-Open No. 2013-162195, an opening is formed in a conductor layer, and a slit is formed in such a way as to connect the opening to an outer edge; an antenna coil is disposed in such a way that an inner diameter portion overlaps with the opening. In the antenna device, current flows through the conductor layer in such a way as to block a magnetic field generated by a flow of current through a coil conductor; and the current flows around the slit that flows around the opening of the conductor layer, and the current also flows around the conductor layer due to the edge effect. As a result, a magnetic field is generated from the conductor layer, and the conductor layer makes a large loop of the magnetic flux, resulting in a longer communication distance between the antenna device and an antenna that the antenna device is communicating with. That is, the conductor layer functions as an accelerator that helps to increase the antenna coil's communication distance.

However, in the above-described conventional antenna device, the opening and slit need to be formed in the conductor layer. Therefore, the problem is that this configuration restricts the layout of the antenna coil. For example, if the opening cannot be formed at a desired position due to design constraints, or if the slit is not allowed to be formed even as the opening can be formed, the problem is that the antenna device cannot be configured. A similar problem arises when an opening used to expose a lens of a camera module cannot be used as an opening for an antenna coil.

An object of the present invention is to provide an antenna device that can increase a communication distance of an antenna coil even when an opening is not provided in a conductor layer provided in a portable electronic device. Further, an object of the present invention is to provide a high-performance portable electronic device that is formed by using such an antenna device.

SUMMARY

To solve the above problems, according to a first aspect of the present invention, an antenna device includes: a first metal member that has a first main surface; a second metal member that has a second main surface parallel to the first main surface; and an antenna coil that has a coil axis perpendicular to the first and second main surfaces, wherein the first metal member constitutes at least a part of a housing of a portable electronic device in which the antenna coil is mounted, at least one slit is formed between the first and second metal members, an inner diameter section of the antenna coil overlaps with the slit in planar view, and the slit has a constant width at least in a region that overlaps with the antenna coil in planar view.

Further, according to the present invention, a portable electronic device includes: a housing; a circuit board that is provided in the housing; and an antenna device that is provided in the housing along with the circuit board, wherein the antenna device includes a first metal member that has a first main surface, a second metal member that has a second main surface parallel to the first main surface, and an antenna coil that has a coil axis perpendicular to the first and second main surfaces, wherein the first metal member constitutes at least apart of the housing, at least one slit is formed between the first and second metal members, an inner diameter section of the antenna coil overlaps with the slit in planar view, and the slit has a constant width at least in a region that overlaps with the antenna coil in planar view.

In a conventional antenna device, an opening that is almost equal in size to an inner diameter section of an antenna coil is formed in advance in a metal layer of a portable electronic device, and the antenna coil needs to be disposed at a position where the opening is formed. Therefore, there are many design constraints. However, in the antenna device of the present invention, without providing an opening, only a slit that is far narrower in width than the inner diameter section of the antenna coil is provided, and the antenna coil is placed in such a way that the slit that extends in one direction overlaps with the inner diameter section. Therefore, the antenna coil can be placed in any location in the direction in which the slit extends, leading to an increase in the degree of freedom in the layout of the antenna coil.

In the present invention, the inner diameter section of the antenna coil preferably includes a portion that overlaps with the first and second metal members in planar view. In the inner diameter section of the antenna coil, the area of a region that does not overlap with the metal members is smaller than that of a conventional antenna device in which an opening is formed in a metal layer. However, this configuration does not cause a problem, and can achieve almost the same antenna characteristics as the conventional antenna device.

In the present invention, a plurality of the slits are preferably provided. It is particularly preferred that the two slits be provided. In this case, the antenna device of the present invention preferably further includes a third metal member provided between the first and second metal members in such a way that two slits are formed between the first and second metal members, wherein the inner diameter section of the antenna coil overlaps with the first and second slits in planar view. When two slits are provided between the first and second metal members, a communication distance of the antenna coil can be longer than when one slit is provided.

The antenna device of the present invention preferably further includes a magnetic sheet that is located farther than the antenna coil is when seen from the first metal member and is fixed to the antenna coil. This configuration increases the inductance of the antenna coil and leads to a longer communication distance of the antenna coil.

In the present invention, the second metal member preferably makes up apart of the housing along with the first metal member. This configuration makes it possible to form the antenna device by utilizing the housing of the portable electronic device, resulting in an increase in the communication distance of the antenna coil.

The antenna device of the present invention preferably includes a cover made of insulating resin, wherein the first and second metal members are made of a metal film formed on a surface of the cover. This configuration makes it possible to form the antenna device by utilizing the metal film that is a part of the housing of the portable electronic device, resulting in an increase in the communication distance of the antenna coil.

According to a second aspect of the present invention, an antenna device includes: a first metal member that has a first main surface; a second metal member that has a second main surface parallel to the first main surface; and an antenna coil that has a coil axis perpendicular to the first and second main surfaces, wherein the second metal member is fixed to the antenna coil, at least one slit is formed between the first and second metal members, and an inner diameter section of the antenna coil overlaps with the slit in planar view.

Further, an antenna device of the present invention includes: an antenna coil that has an inner diameter section; and a metal member that is fixed to the antenna coil and includes a main surface intersecting a coil axis of the antenna coil and which does not cover a portion of the antenna coil and a portion of the inner diameter section while covering a remaining portion of the antenna coil and a remaining portion of the inner diameter section.

Furthermore, a portable electronic device of the present invention includes: a housing; a circuit board that is provided in the housing; and an antenna device that is provided in the housing along with the circuit board, wherein the antenna device includes a first metal member that has a first main surface, a second metal member that has a second main surface parallel to the first main surface, and an antenna coil that has a coil axis perpendicular to the first and second main surfaces, wherein the second metal member is fixed to the antenna coil, at least one slit is formed between the first and second metal members, and an inner diameter section of the antenna coil overlaps with the slit in planar view.

In a conventional antenna device, an opening that is almost equal in size to an inner diameter section of an antenna coil is formed in advance in a metal layer of a portable electronic device, and the antenna coil needs to be disposed in such a way that the inner diameter section overlaps with the opening. Therefore, there are many design constraints. However, in the antenna device of the present invention, the metal layer (second metal member) that is different from the metal layer (first metal member) of the main body side of the portable electronic device is fixed to the antenna coil in advance, and the first and second metal members are used in combination to make a slit, and the antenna coil is provided in such a way that the slit and the inner diameter section overlap in planar view. Therefore, the position of the slit, as well as the antenna coil, can be freely set. Accordingly, the antenna coil can be placed in any location in an end portion of the first metal member, thereby leading to an increase in the degree of freedom in the layout of the antenna coil. In the inner diameter section of the antenna coil, the area of a region not covered with metal is smaller than that of a conventional antenna device in which an opening is formed in a metal layer. However, this configuration does not cause a problem, and it is possible to achieve almost the same antenna characteristics as the conventional antenna device.

According to the present invention, material of the second metal member is preferably different from material of the first metal member. If a metal member that makes up a housing of a portable electronic device or a battery pack is used as the first metal member, materials for the member are limited due to design constraints. In contrast, the second metal member is not specifically limited, and a material that is different from the first metal member is available. Therefore, it is possible to improve the antenna characteristics and reduce costs.

According to the present invention, an opening that overlaps with the slit is preferably further provided between the first and second metal members, and the inner diameter section of the antenna coil overlaps with the opening in planar view. This configuration makes it possible to provide the opening at a position where the opening overlaps with the inner diameter section of the antenna coil overlaps, and to widen a passage area of magnetic flux. In particular, the position of the opening can be moved together with the antenna coil. Therefore, it is possible to increase the degree of freedom in the layout of the antenna coil.

According to the present invention, the first metal member is preferably a metal cover section that constitutes at least a part of a housing of a portable electronic device in which the antenna coil is mounted. This configuration makes it possible to form the antenna device by utilizing the metal cover section, resulting in an increase in the communication distance of the antenna coil.

According to the present invention, the first metal member is preferably a battery pack of a portable electronic device in which the antenna coil is mounted. This configuration makes it possible to form the antenna device by utilizing the battery pack, resulting in an increase in the communication distance of the antenna coil.

The antenna device of the present invention preferably includes a cover made of insulating resin, wherein the first metal member is made of a metal film formed on a surface of the cover. This configuration makes it possible to form the antenna device by utilizing the metal film that is part of the housing of the portable electronic device, resulting in an increase in the communication distance of the antenna coil.

The antenna device of the present invention preferably further includes a magnetic sheet that is located farther than the antenna coil when seen from the first metal member and is fixed to the antenna coil. This configuration increases the inductance of the antenna coil and leads to a longer communication distance of the antenna coil.

According to the present invention, a width of the second metal member that is parallel to the slit is preferably equal to the inner diameter section of the antenna coil. According to this configuration, a coil pattern does not overlap with the metal sheet more than necessary. Therefore, it is possible to reduce the loss of magnetic flux and improve the communication distance.

In the present invention, a plurality of the slits are preferably provided. It is particularly preferred that the two slits be provided. In this case, the antenna device of the present invention preferably further includes a third metal member provided between the first and second metal members in such a way that two slits are formed between the first and second metal members, wherein the third metal member is fixed to the antenna coil along with the second metal member, and the inner diameter section of the antenna coil overlaps with the first and second slits in planar view. When two slits are provided between the first and second metal members, a communication distance of the antenna coil can be longer than when one slit is provided.

According to the present invention, it is possible to provide an antenna device that can increase a communication distance of an antenna coil even when an opening is not provided in a conductor layer. Moreover, according to the present invention, it is possible to provide a high-performance portable electronic device that is formed by using such an antenna device.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1A:
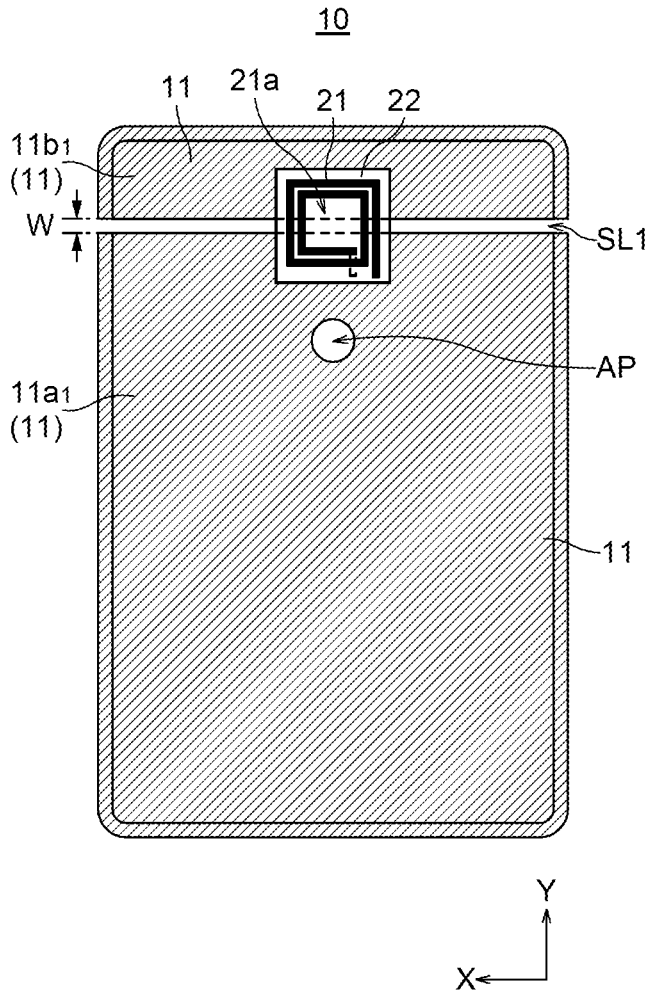
FIG. 1A is a schematic front cross-sectional view showing the configuration of a portable electronic device including an antenna device of a first embodiment of the present invention.
Figure 1B:
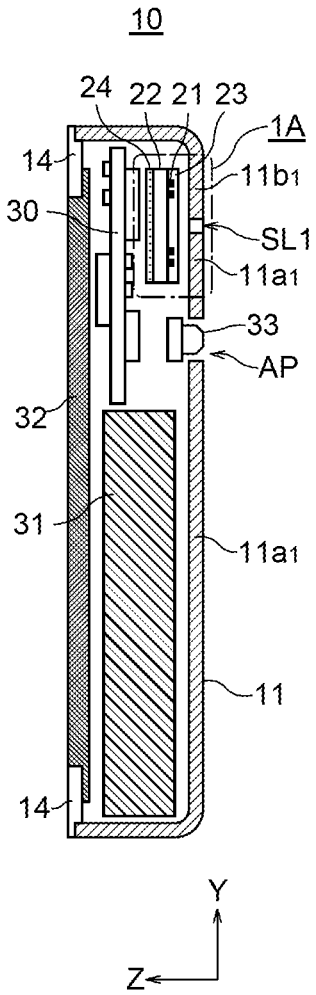
FIG. 1B is a schematic side cross-sectional view showing the configuration of the portable electronic device including the antenna device of the first embodiment of the present invention.

FIGS. 1A and 1B are diagrams showing the configuration of a portable electronic device including an antenna device of a first embodiment of the present invention. FIG. 1A is a schematic front cross-sectional view. FIG. 1B is a schematic side cross-sectional view.

As shown in FIGS. 1A and 1B, an antenna device 1A includes a cover 11, which makes up a housing of a portable electronic device 10 and is made of metal, and an antenna coil 21, which has a coil axis that is perpendicular to a main surface of the cover 11. Although not specifically limited, the portable electronic device 10 may be a smartphone.

The portable electronic device 10 has an outer shape of a thin rectangular parallelepiped. Inside the portable electronic device 10, a main circuit board 30 and a battery pack 31 are built. On one main surface (front surface) of the portable electronic device 10, a display 32 is provided. In an outer peripheral portion of the display 32, a resin frame is provided. Although not specifically limited, the antenna coil 21 is provided on one end side (upper portion) of a longitudinal direction (Y-direction) of the portable electronic device 10 along with the main circuit board 30, and the battery pack 31 is provided on the other end side (lower portion).

The cover 11 forms the other main surface (back surface) and four side surfaces of the portable electronic device 10. The reason why the cover 11 is made of metal is because the cover 11 can be made thinner and lighter while the rigidity and magnetic shielding performance can be increased. In the cover 11, an opening AP is formed. A camera 33 is provided in such a way as to be exposed via the opening AP.

In the cover 11, one slit SL1 is formed independently of the opening AP. The slit SL1 is located on one end side of the longitudinal direction of the portable electronic device 10. In the slit SL1, an insulating resin is provided. The insulating resin makes up a part of the housing along with the cover 11. The slit SL1 extends in a width direction (X-direction) of the cover 11 in such a way as to split the cover 11. In this manner, the cover 11 is divided into a first metal member $\mathbf{11}a_1$ and a second metal member $\mathbf{11}b_1$. The first metal member $\mathbf{11}a_1$ is electrically insulated from the second metal member $\mathbf{11}b_1$. A main surface (second main surface) of the second metal member $\mathbf{11}b_1$ is flush with a main surface (first main surface) of the first metal member $\mathbf{11}a_1$, and the main surfaces make up the back surface of the portable electronic device 10.

The antenna coil 21 is a planar antenna that includes a rectangular spiral conductor. The antenna coil 21 is formed on a main surface of a flexible substrate 22. The antenna coil 21 is covered with an insulation film 23. On the back surface of the flexible substrate 22, a magnetic sheet 24 is provided. The flexible substrate 22 and the magnetic sheet 24 are located farther from the cover 11 than the position of the antenna coil 21. The magnetic sheet 24 makes up a magnetic path of magnetic flux generated from the antenna coil 21.

The antenna coil 21 is disposed near a boundary between the first metal member $\mathbf{11}a_1$ and the second metal member $\mathbf{11}b_1$. An almost lower half of the antenna coil 21 overlaps with the first metal member $\mathbf{11}a_1$ in planar view. Meanwhile, an almost upper half of the antenna coil 21 does not overlap with the first metal member $\mathbf{11}a_1$ in planar view, while overlapping with the second metal member $\mathbf{11}b_1$. Between the first metal member $\mathbf{11}a_1$ and the second metal member $\mathbf{11}b_1$, a slit SL1 of a constant width is formed in such a way as to extend in the width direction of the portable electronic device 10. An up-down-direction central region of the antenna coil 21 is a region that does not overlap with both the first metal member $\mathbf{11}a_1$ and the second metal member $\mathbf{11}b_1$.

The method of fixing the antenna coil 21 is not specifically limited. The antenna coil 21 may be fixed to the main circuit board 30 side or to the cover 11 side. If the battery pack 31 is placed in such a way as to overlap with the antenna coil 21, the antenna coil 21 may be fixed on the battery pack 31. The antenna coil 21 that is disposed on the flexible substrate 22 faces outward. Instead, the antenna coil 21 may be placed in such a way as to face inward.

Although not shown in the diagrams, both ends of the antenna coil 21 are connected to corresponding connectors on the main circuit board 30. The connection method is not specifically limited. For example, the main circuit board 30 and the antenna coil 21 may be connected together via a pullout conductor, which is formed in a lead section of the flexible substrate 22. Alternatively, a power supply pin may be used for the connection.

The width W of the slit SL1 is less than the width of an inner diameter section 21*a* of the antenna coil 21. The slit SL1 crosses over the inner diameter section of the antenna coil 21. That is, the antenna coil 21 is laid out in such a way that the inner diameter section thereof overlaps with the slit SL1 in planar view. It is preferred that the portions of the antenna coil 21 that are substantially parallel to the slit SL1 overlap with the first metal member $\mathbf{11}a_1$ and the second metal member $\mathbf{11}b_1$.

The slit SL1 is preferably a straight slit of a constant width extending from one end of the cover 11 to the other end in the width direction (X-direction). However, the slit SL1 is not necessarily of a constant width across the entire length thereof. All that is required is for the slit SL1 to have a constant width in a region that overlaps with a mounting area of the antenna coil 21 in planar view.

Figure 2:
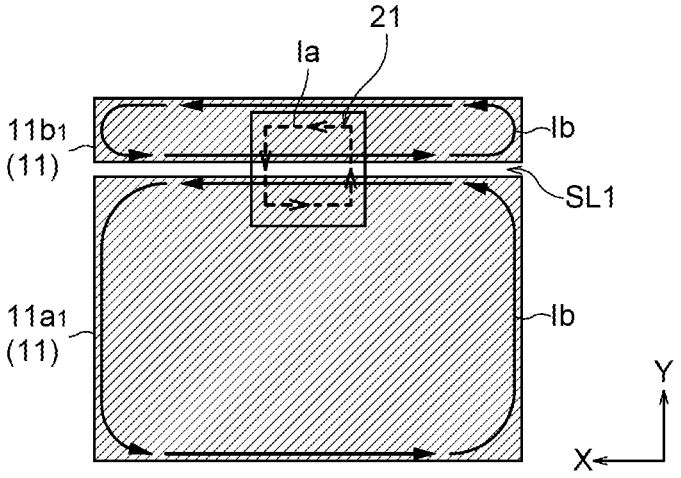
FIG. 2 is a schematic plan view for explaining how a cover 11 works for an antenna coil 21.
Figure 3:
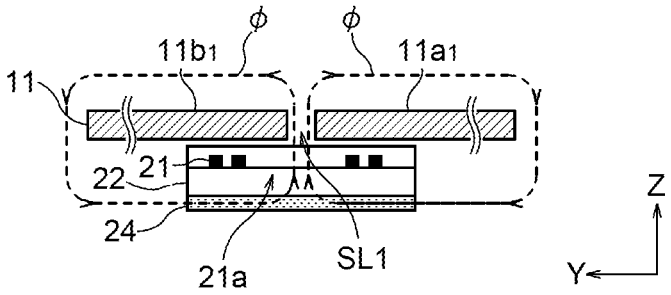
FIG. 3 is a schematic cross-sectional view for explaining how the cover 11 works for the antenna coil 21.

FIGS. 2 and 3 are diagrams for explaining how the cover 11 works for the antenna coil 21. FIG. 2 is a schematic plan view. FIG. 3 is a schematic cross-sectional view.

As shown in FIGS. 2 and 3, when current Ia flows through the antenna coil 21 in a counterclockwise direction, magnetic flux φ is generated in such a way as to penetrate the inner diameter section of the antenna coil 21. The magnetic flux φ passes through the slit SL1 and is interlinked with the cover 11. Meanwhile, current generated by magnetic flux in a direction of counteracting the above magnetic flux, flows through the cover 11. Due to the edge effect, the current is transformed into eddy current Ib, which travels along the peripheries of the first and second metal members $\mathbf{11}a_1$ and $\mathbf{11}b_1$. The direction of the eddy current Ib is the same as that of the current Ia flowing through the antenna coil 21, or the counterclockwise direction.

The magnetic flux φ that has passed through the slit SL1 does not penetrate the cover 11. Accordingly, the magnetic flux φ tries to bypass via a route whose inner side is the slit SL1 of the cover 11 and whose outer side is an outer edge of the cover 11. As a result, the magnetic flux φ forms a relatively large loop, and becomes to be interlinked with an antenna coil of a reader/writer (not shown), for example. That is, the antenna device 1A is magnetically coupled with an antenna that the antenna device 1A will communicate with. In particular, the area of the cover 11 is larger than the area of the antenna coil 21. Therefore, a large-loop magnetic field can be generated. Furthermore, when seen from outside the cover 11, the magnetic sheet 24 is located farther from the cover 11 than the position of the antenna coil 21. This configuration increases the inductance of the antenna coil 21, resulting in an improvement in antenna characteristics.

Figure 4A:
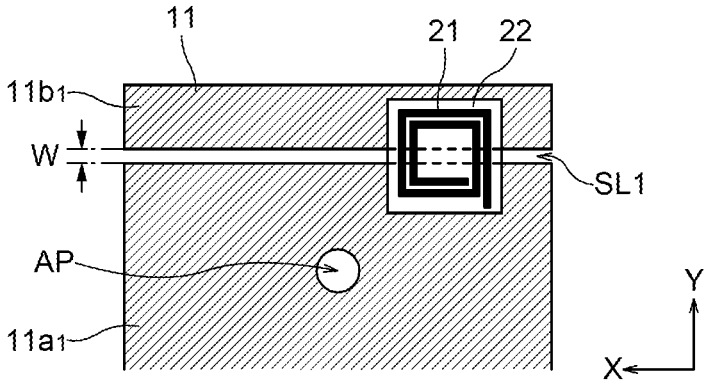
FIG. 4A is a schematic plan view showing an example of layout of the antenna coil 21.
Figure 4B:
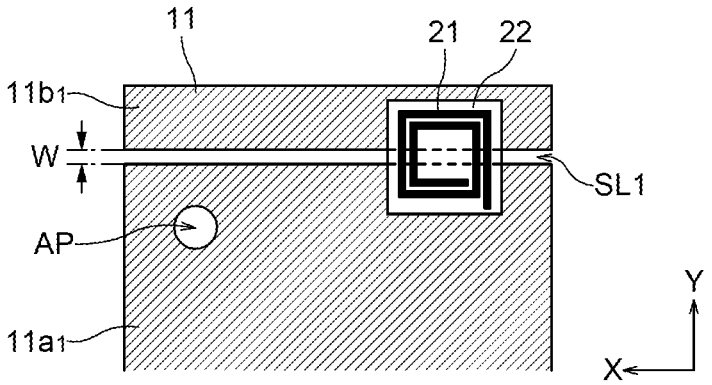
FIG. 4B is a schematic plan view showing an example of layout of the antenna coil 21.

FIGS. 4A and 4B are schematic plan views showing examples of layout of the antenna coil 21.

As shown in FIG. 4A, the antenna coil 21 is offset-disposed in a width-direction right end portion. An opening AP, through which the camera 33 is exposed, is disposed in a width-direction central portion. The opening AP and the slit SL1 are not connected, and are independent of each other. This configuration makes it possible to place the camera 33 at the center, separate the antenna coil 21 from the camera 33, and give leeway for the layout of the antenna coil 21. That is, without being restricted by the position of the opening AP, the antenna coil 21 can be freely laid out.

As shown in FIG. 4B, the antenna coil 21 is offset-disposed in a width-direction right end portion. An opening AP, through which the camera 33 is exposed, is offset-disposed in a width-direction left end portion. The opening AP and the slit SL1 are not connected, and are independent of each other. This configuration makes it possible to further separate the antenna coil 21 from the camera 33 and give leeway for the layout of the antenna coil 21.

As described above, in the antenna device 1A of the present embodiment, the cover 11 makes a large loop of the magnetic flux of the antenna coil 21. Therefore, the communication distance from the antenna device to an antenna that the antenna device will communicate with becomes longer. Moreover, the antenna coil 21 is placed in such a way as to overlap with the slit SL1 of the cover 11 in planar view, and, in particular, the slit SL1 crosses over the inner diameter section 21*a* of the antenna coil 21. Therefore, the antenna coil 21 can be placed in any location in the direction in which the slit SL extends, leading to an increase in the degree of freedom in the layout of the antenna coil 21.

Figure 5A:
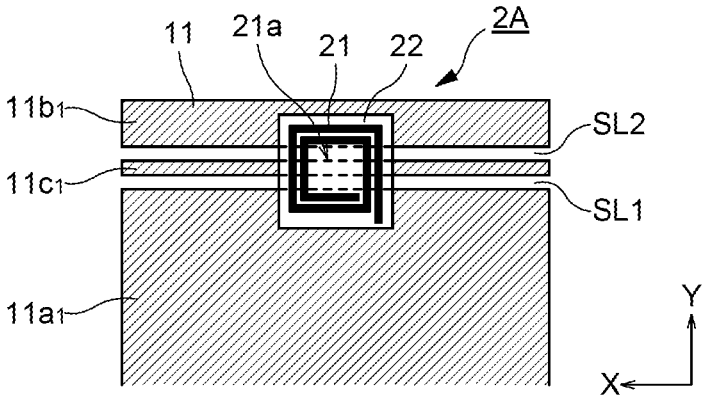
FIG. 5A is a schematic front view showing the configuration of an antenna device according to a second embodiment of the present invention.
Figure 5B:
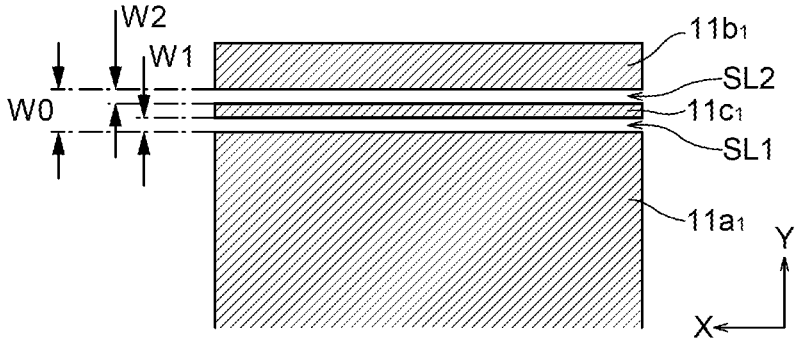
FIG. 5B is a schematic front view showing the configuration of the antenna device according to the second embodiment of the present invention and shows the situation where an antenna coil 21 is removed from that shown in FIG. 5A.
Figure 5C:
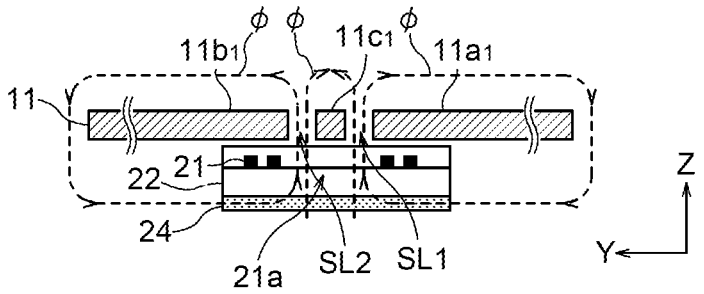
FIG. 5C is a schematic side cross-sectional view showing the configuration of the antenna device according to the second embodiment of the present invention.

FIGS. 5A to 5C are diagrams showing the configuration of an antenna device according to a second embodiment of the present invention. FIGS. 5A and 5B are schematic front views. FIG. 5C is a schematic side cross-sectional view. FIG. 5B shows the situation where an antenna coil 21 is removed from that shown in FIG. 5A.

As shown in FIGS. 5A to 5C, an antenna device 2A is characterized in that two slits SL1 and SL2 are formed in a cover 11. The rest of the configuration is the same as that of the first embodiment. Although not specifically limited, the width W1 of the slit SL1 is preferably equal to the width W2 of the slit SL2.

In order to form the two slits SL1 and SL2, a third metal member $\mathbf{11}c_1$ is provided between a first metal member $\mathbf{11}a_1$ and a second metal member $\mathbf{11}b_1$. The third metal member $\mathbf{11}c_1$ has an elongated linear shape that is parallel to the slits SL1 and SL2. The third metal member $\mathbf{11}c_1$ is preferably larger in width than the slits SL1 and SL2. However, if the third metal member $\mathbf{11}c_1$ is too large in width, it is impossible that the slits SL1 and SL2 are placed within the inner diameter section of the antenna coil 21. Therefore, the width of the third metal member $\mathbf{11}c_1$ needs to be set appropriately. The width W0 from the slit SL1 to the slit SL2 needs to be narrower than the inner diameter section 21*a* of the antenna coil 21. it is impossible that all the slits SL1 to SL3 are placed within The slit SL1 extends in the width direction (X-direction) of the cover 11 and splits the cover 11. The slit SL2 extends in the width direction of the cover 11 and splits the cover 11. As a result, the cover 11 is divided into first metal member $\mathbf{11}x_1$, the second metal member $\mathbf{11}b_1$, and the third metal member $\mathbf{11}c_1$. The first to third metal members to $\mathbf{11}c_1$ are electrically insulated from each other.

The advantage of the antenna device 2A of the present embodiment is equal to or greater than the advantage of the antenna device 1A of the first embodiment. That is, the cover 11 makes a large loop of the magnetic flux of the antenna coil 21. Therefore, the communication distance from the antenna device to an antenna that the antenna device will communicate with becomes longer. Especially when two slits are provided, the communication distance of the antenna coil is longer than when one slit is provided. Moreover, the antenna coil 21 is placed in such a way as to overlap with the slits SL1 and SL2 of the cover 11 in planar view, and, in particular, the slits SL1 and SL2 cross over the inner diameter section 21*a* of the antenna coil 21. Therefore, the antenna coil 21 can be placed in any location in the direction in which the slits SL1 and SL2 extend, leading to an increase in the degree of freedom in the layout of the antenna coil 21.

Figure 6A:
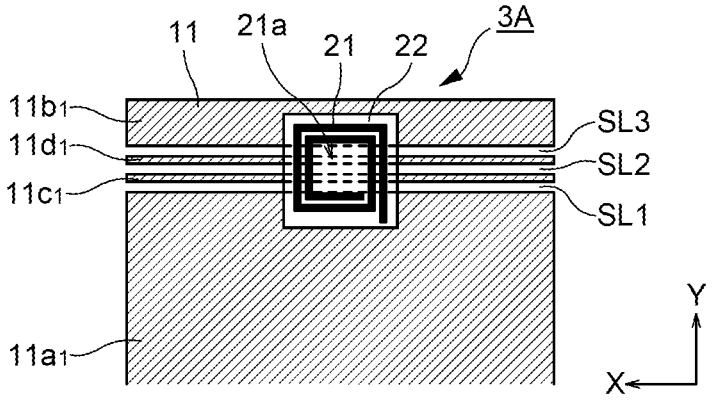
FIG. 6A is a schematic front view showing the configuration of an antenna device according to a third embodiment of the present invention.
Figure 6B:
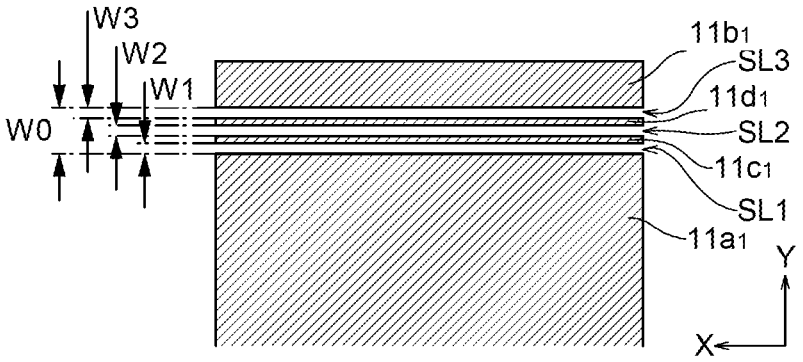
FIG. 6B is a schematic front view showing the configuration of the antenna device according to the third embodiment of the present invention and shows the situation where the antenna coil 21 is removed from that shown in FIG. 6A.
Figure 6C:
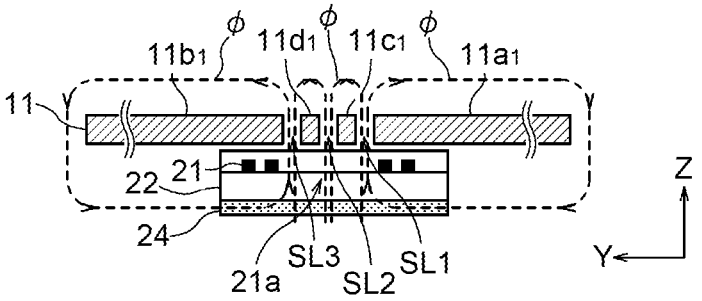
FIG. 6C is a schematic side cross-sectional view showing the configuration of the antenna device according to the third embodiment of the present invention.

FIGS. 6A to 6C are diagrams showing the configuration of an antenna device according to a third embodiment of the present invention. FIGS. 6A and 6B are schematic front views. FIG. 6C is a schematic side cross-sectional view.

As shown in FIGS. 6A to 6C, an antenna device 3A is characterized in that three slits SL1, SL2, and SL3 are formed in a cover 11. The rest of the configuration is the same as that of the first embodiment. Although not specifically limited, the width W1 of the slit SL1, the width W2 of the slit SL2, and the width W3 of the slit SL3 are preferably equal.

In order to form the three slits SL1, SL2, and SL3, between a first metal member $11a_1$ and a second metal member $11b_1$, a third metal member $11c_1$ and a fourth metal member $11d_1$ are provided. The third and fourth metal members $11c_1$ and $11d_1$ each have an elongated linear shape that is parallel to the slits SL1, SL2, and SL3. The third and fourth metal members $11c_1$ and $11d_1$ are preferably larger in width than the slits SL1, SL2, and SL3. However, if the third and fourth metal members 11c1 and $11d_1$ are too large in width, it is impossible that all the slits SL1 to SL3 are placed within the inner diameter section of the antenna coil 21. Therefore, the width of the third and fourth metal members $11c_1$ and $11d_1$ needs to be set appropriately. The width W0 from the slit SL1 to the slit SL3 needs to be narrower than the inner diameter section of the antenna coil 21.

The slit SL1 extends in the width direction of the cover 11 and splits the cover 11. The slit SL2 extends in the width direction of the cover 11 and splits the cover 11. The slit SL3 extends in the width direction of the cover 11 and splits the cover 11. As a result, the cover 11 is divided into first metal member $11a_1$, the second metal member $11b_1$, the third metal member $11c_1$, and the fourth metal member $11d_1$. The first to fourth metal members 11*a* to 11*d* are electrically insulated from each other.

The antenna device 3A of the present embodiment can achieve the same advantageous effect as the antenna device 1A of the first embodiment. That is, the cover 11 makes a large loop of the magnetic flux of the antenna coil 21. Therefore, the communication distance from the antenna device to an antenna that the antenna device will communicate with becomes longer. Moreover, the antenna coil 21 is placed in such away as to overlap with the slits SL1 to SL3 of the cover 11 in planar view, and, in particular, the slits SL1 to SL3 cross over the inner diameter section 21*a* of the antenna coil 21. Therefore, the antenna coil 21 can be placed in any location in the direction in which the slits SL1 to SL3 extend, leading to an increase in the degree of freedom in the layout of the antenna coil 21.

Figure 7A:
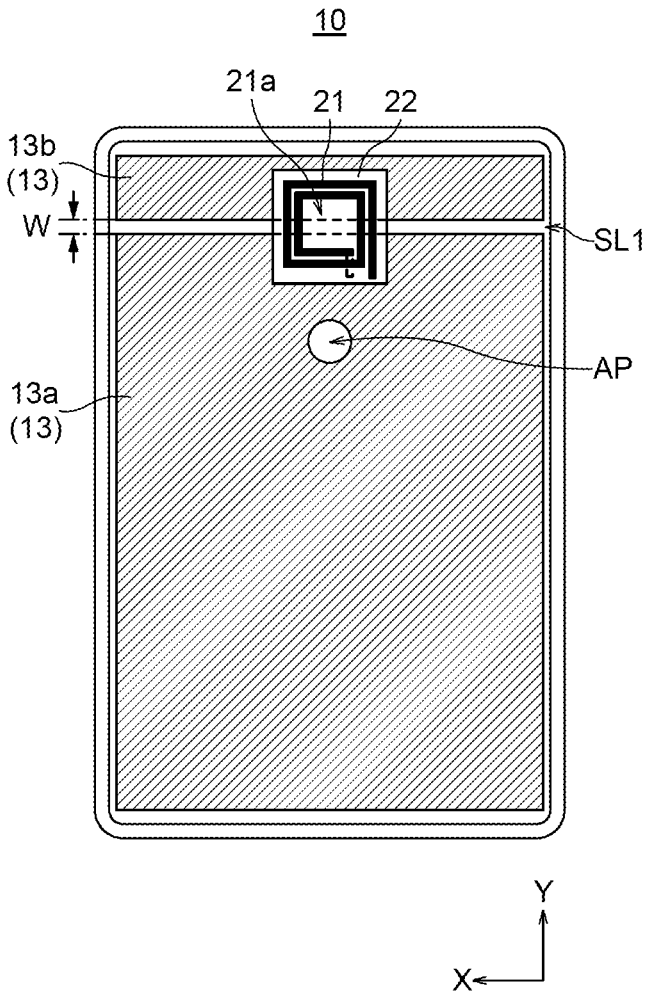
FIG. 7A is a schematic front cross-sectional view showing the configuration of a portable electronic device including an antenna device according to a fourth embodiment of the present invention.
Figure 7B:
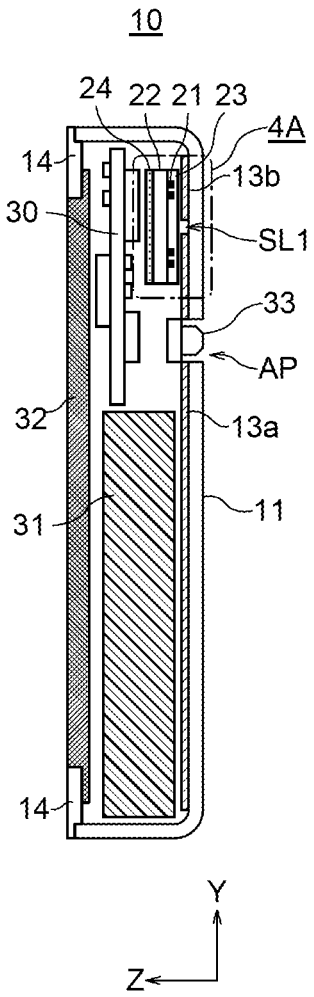
FIG. 7B is a schematic side cross-sectional view showing the configuration of the portable electronic device including the antenna device according to the fourth embodiment of the present invention.

FIGS. 7A and 7B are diagrams showing the configuration of a portable electronic device including an antenna device of a fourth embodiment of the present invention. FIG. 7A is a schematic front cross-sectional view. FIG. 7B is a schematic side cross-sectional view.

As shown in FIGS. 7A and 7B, an antenna device 4A is characterized in that a cover 11 is made of insulating resin, and that a metal film 13 is formed on the back surface of the cover 11. The cover 11 makes up the opposite main surface (back surface) and four side surfaces of the portable electronic device 10. The metal film 13 covers a majority of the main surface of the cover 11 over a wide range. The metal film 13 is substantially a part of the housing.

In the cover 11 and the metal film 13, an opening AP is formed. A camera 33 is provided in such a way as to be exposed via the opening A?. In the metal film 13, one slit SL1 is formed independently of the opening A?. The slit SL1 is located on one end side of the longitudinal direction of the portable electronic device 10. The slit SL1 extends in a width direction (X-direction) of the metal film 13 in such a way as to split the metal film 13. In this manner, the metal film 13 is divided into a first metal member 13*a* and a second metal member 13*b*. The first metal member 13*a* is electrically insulated from the second metal member 13*b*. A main surface (second main surface) of the second metal member 13*b* is flush with a main surface (first main surface) of the first metal member 13*a*, and the main surfaces are parallel to the back surface of the portable electronic device 10.

The antenna device 4A of the present embodiment can achieve the same advantageous effect as the antenna device 1A of the first embodiment. That is, the metal film 13 makes a large loop of the magnetic flux of the antenna coil 21. Therefore, the communication distance from the antenna device to an antenna that the antenna device will communicate with becomes longer. Moreover, the antenna coil 21 is placed in such a way as to overlap with the slit SL1 of the metal film 13 in planar view, and, in particular, the slit SL1 crosses over the inner diameter section 21*a* of the antenna coil 21. Therefore, the antenna coil 21 can be placed in any location in the direction in which the slit SL1 extends, leading to an increase in the degree of freedom in the layout of the antenna coil 21.

Figure 8A:
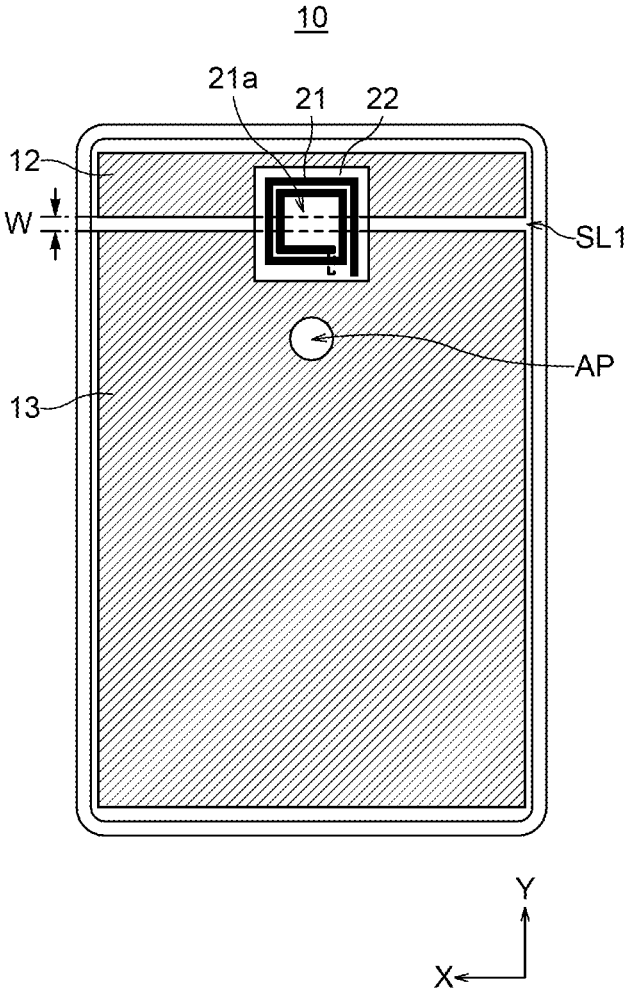
FIG. 8A is a schematic front cross-sectional view showing the configuration of a portable electronic device including an antenna device according to a fifth embodiment of the present invention.
Figure 8B:
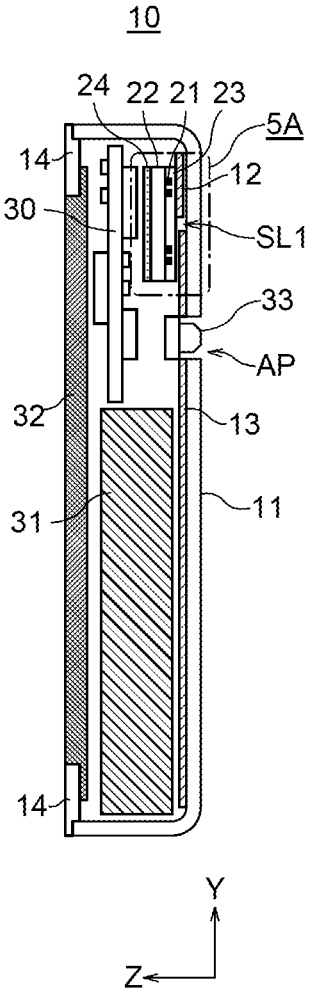
FIG. 8B is a schematic side cross-sectional view showing the configuration of the portable electronic device including the antenna device according to the fifth embodiment of the present invention.

FIGS. 8A and 8B are diagrams showing the configuration of a portable electronic device including an antenna device of a fifth embodiment of the present invention. FIG. 8A is a schematic front cross-sectional view. FIG. 8B is a schematic side cross-sectional view.

As shown in FIGS. 8A and 8B, an antenna device 5A is characterized in that a metal film 13 is formed on the back surface of a cover 11 made of insulating resin, and that a metal sheet 12 fixed to an antenna coil 21 is provided. The metal film (first metal member) 13 on the cover 11 side and the metal sheet (second metal member) 12 on the antenna coil 21 side are used in combination to form a slit SL1. A main surface (second main surface) of the metal sheet 12 is parallel to a main surface (first main surface) of the metal film 13. The rest of the configuration is the same as that of the fourth embodiment.

The antenna device 5A of the present embodiment can achieve the same advantageous effect as the antenna device 1A of the first embodiment. That is, the metal film 13 and the metal sheet 12 makes a large loop of the magnetic flux of the antenna coil 21. Therefore, the communication distance from the antenna device to an antenna that the antenna device will communicate with becomes longer. Moreover, the antenna coil 21 is placed in such a way as to overlap with the slit SL1 located between the metal film 13 and the metal sheet 12 in planar view, and, in particular, the slit SL1 crosses over the inner diameter section 21*a* of the antenna coil 21. Therefore, the antenna coil 21 can be placed in any location in the direction in which the slit SL1 extends, leading to an increase in the degree of freedom in the layout of the antenna coil 21. Furthermore, the housing itself does not have to have the slit SL1. Therefore, the degree of freedom in the design of the housing can be increased.

Figure 9A:
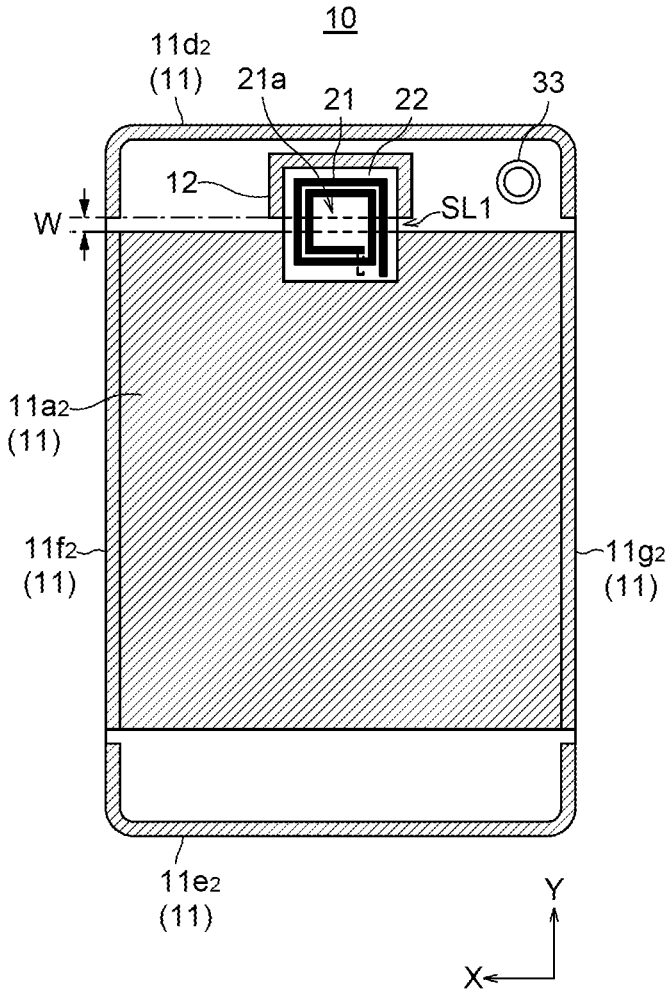
FIG. 9A is a schematic front cross-sectional view showing the configuration of a portable electronic device including an antenna device according to an sixth embodiment of the present invention.
Figure 9B:
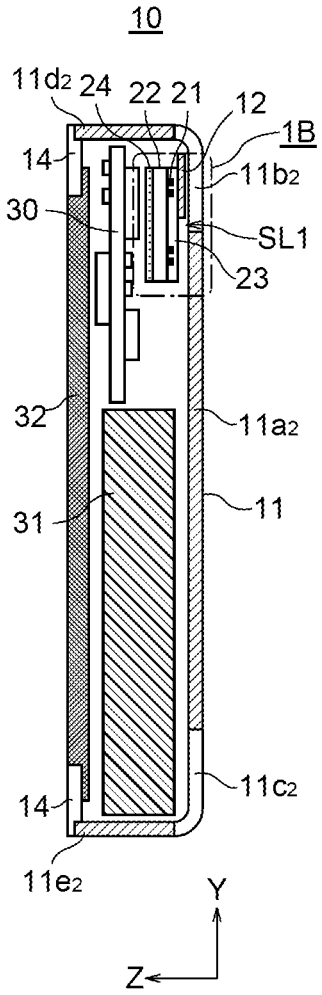
FIG. 9B is a schematic side cross-sectional view showing the configuration of the portable electronic device including the antenna device according to the sixth embodiment of the present invention.

FIGS. 9A and 9B are diagrams showing the configuration of a portable electronic device including an antenna device of a sixth embodiment of the present invention. FIG. 9A is a schematic front cross-sectional view. FIG. 9B is a schematic side cross-sectional view.

As shown in FIGS. 9A and 9B, an antenna device 1B includes a metal cover section $11a_2$, which is a part of a cover 11 that makes up a housing of a portable electronic device 10; an antenna coil 21, which has a coil axis perpendicular to a planar direction of a main surface of the metal cover section $11a_2$; and a metal sheet 12, which is fixed to the antenna coil 21. Although not specifically limited, the portable electronic device 10 may be a smartphone.

The portable electronic device 10 has an outer shape of a thin rectangular parallelepiped. Inside the portable electronic device 10, a main circuit board 30 and a battery pack 31 are built. On one main surface (front surface) of the portable electronic device 10, a display 32 is provided. In an outer peripheral portion of the display 32, a resin frame is provided. Although not specifically limited, the antenna coil 21 is provided on one end side (upper portion) of a longitudinal direction (Y-direction) of the portable electronic device 10 along with the main circuit board 30, and the battery pack 31 is provided on the other end side (lower portion).

The cover 11 makes up the other main surface (back surface) and four side surfaces of the portable electronic device 10. The back surface of the portable electronic device 10 is mainly made up of the metal cover section $\mathbf{11}a_2$. However, all of the back surface is not made of metal. In both end portions of the longitudinal direction, resin cover sections $\mathbf{11}b_2$ and $\mathbf{11}c_2$, which are made of insulating resin, are provided. Furthermore, four side surfaces of the portable electronic device 10 are formed by side surface cover sections $\mathbf{11}d_2$, $\mathbf{11}e_2$, $\mathbf{11}f_2$, and $\mathbf{11}g_2$, which are made of the same metal material as that of the metal cover section $\mathbf{11}a_2$. The reason why major portions of the cover 11 are made of metal is because the cover 11 can be made thinner and lighter while the rigidity and magnetic shielding performance can be increased. The reason why some parts of the cover 11 are made of resin is to prevent the built-in antenna from being completely shielded by the metal and to prevent the transmission and reception of radio waves from being blocked.

The antenna coil 21 is a planar antenna that includes a rectangular spiral conductor. The antenna coil 21 is formed on a main surface of a flexible substrate 22. The antenna coil 21 is covered with an insulation film 23. On the back surface of the flexible substrate 22, a magnetic sheet 24 is provided. The flexible substrate 22 and the magnetic sheet 24 are located farther from the cover 11 than the position of the antenna coil 21. The magnetic sheet 24 makes up a magnetic path of magnetic flux generated from the antenna coil 21.

The antenna coil 21 is disposed near a boundary between the metal cover section $\mathbf{11}a_2$ and the resin cover section $\mathbf{11}b_2$. An almost lower half of the antenna coil 21 overlaps with the metal cover section $\mathbf{11}a_2$ in planar view. An almost upper half of the antenna coil 21 does not overlap with the metal cover section $\mathbf{11}a_2$ in planar view, while overlapping with the resin cover section $\mathbf{11}b_2$. Between the antenna coil 21 and the resin cover section $\mathbf{11}b_2$, a metal sheet 12 is provided in such a way as to cover an almost upper half of the antenna coil 21. Between the metal cover section $\mathbf{11}a_2$ (first metal member) and the metal sheet 12 (second metal member), a slit SL1 of a constant width is formed in such a way as to extend in the width direction of the portable electronic device 10. An up-down-direction central area of the antenna coil 21 is a region that does not overlap with the metal cover section $\mathbf{11}a_2$ and the metal sheet 12. The metal sheet 12 and the metal cover section $\mathbf{11}a_2$ are electrically insulated from each other by the slit SL1.

The metal sheet 12 may be made of the same material as that of the metal cover section $\mathbf{11}a_2$, or of a different material. The material of the cover 11 is selected to realize the basic functionality thereof, and therefore cannot be chosen freely. However, the material of the metal sheet 12 can be freely selected. Therefore, with the aim of improving the antenna characteristics, the metal sheet 12 may be made of a material that is different from that of the metal cover section $\mathbf{11}a_2$.

The resin cover sections $\mathbf{11}b_2$ and $\mathbf{11}c_2$ make up the housing of the portable electronic device 10 together with the metal cover section $\mathbf{11}a_2$. The resin cover sections $\mathbf{11}b_2$ and $\mathbf{11}c_2$ are respectively provided across a substantially entire surface in the width direction (X-direction) of the back surface of the cover 11 in both end portions of the longitudinal direction (Y-direction). In the resin cover section $\mathbf{11}b_2$, one opening is formed. A camera 33 is provided in such a way as to be exposed via the opening. The camera 33 is provided in a width-direction one end portion in such a way as not to overlap with the antenna coil 21 in planar view.

The method of fixing the antenna coil 21 is not specifically limited. The antenna coil 21 may be fixed to the main circuit board 30 side or to the cover 11 side. If the battery pack 31 is placed in such away as to overlap with the antenna coil 21, the antenna coil 21 may be fixed on the battery pack 31. The antenna coil 21 that is disposed on the flexible substrate 22 faces outward. Instead, the antenna coil 21 may be placed in such a way as to face inward.

Although not shown in the diagrams, both ends of the antenna coil 21 are connected to corresponding connectors on the main circuit board 30. The connection method is not specifically limited. For example, the main circuit board 30 and the antenna coil 21 may be connected together via a pullout conductor, which is formed in a lead section of the flexible substrate 22. Alternatively, a power supply pin may be used for the connection.

The width W of the slit SL1 is less than the width of an inner diameter section 21*a* of the antenna coil 21. The slit SL1 crosses over the inner diameter section of the antenna coil 21. That is, the antenna coil 21 is laid out in such a way that the inner diameter section thereof overlaps with the slit SL1 in planar view. It is preferred that the portions of the antenna coil 21 that are substantially parallel to the slit SL1 overlap with the metal cover section $\mathbf{11}a_2$ and the metal sheet 12.

The slit SL1 is not necessarily of a constant width across the entire length thereof. All that is required is for the slit SL1 to have a constant width in a region that overlaps with a mounting area of the antenna coil 21 in planar view. Instead of being formed in such a way as to have a constant width in planar view, the slit SL1 may be formed in such a way as to have a constant width in a height direction by utilizing a difference of height between the metal cover section $\mathbf{11}a_2$ and the metal sheet 12.

Figure 10:
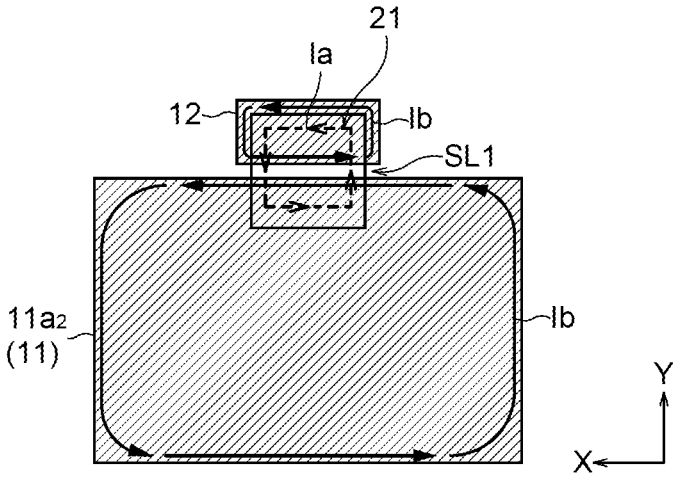
FIG. 10 is a schematic plan view showing how a metal cover section 11$a_2$ and a metal sheet 12 work for an antenna coil 21.
Figure 11:
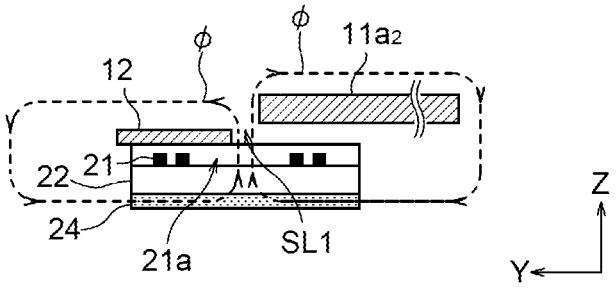
FIG. 11 is a schematic cross-sectional view showing how the metal cover section 11$a_2$ and the metal sheet 12 work for the antenna coil 21.

FIGS. 10 and 11 are diagrams showing how the metal cover section $\mathbf{11}a_2$ and the metal sheet 12 work for the antenna coil 21. FIG. 10 is a schematic plan view. FIG. 11 is a schematic cross-sectional view.

As shown in FIGS. 10 and 11, when current Ia flows through the antenna coil 21 in a counterclockwise direction, magnetic flux φ is generated in such a way as to penetrate the inner diameter section of the antenna coil 21. The magnetic flux φ passes through the slit SL1 and is interlinked with the metal cover section $\mathbf{11}a_2$ and the metal sheet 12. Meanwhile, current generated by magnetic flux in a direction of counteracting the above magnetic flux, flows through the metal cover section $\mathbf{11}a_2$ and the metal sheet 12. Due to the edge effect, the current is transformed into eddy current Ib, which travels along the peripheries of the metal cover section $\mathbf{11}a_2$ and the metal sheet 12. The direction of the eddy current Ib is the same as that of the current Ia flowing through the antenna coil 21, or the counterclockwise direction.

The magnetic flux φ that has passed through the slit SL1 does not penetrate the metal cover section $\mathbf{11}a_2$ and the metal sheet 12. Accordingly, the magnetic flux φ tries to bypass via a route whose inner side is the slit SL1 of the metal cover section $\mathbf{11}a_2$ and the metal sheet 12 and whose outer side is an outer edge of the cover 11. As a result, the magnetic flux φ forms a relatively large loop, and becomes to be interlinked with an antenna coil of a reader/writer (not shown), for example. That is, the antenna device 1B is magnetically coupled with an antenna that the antenna device 1A will communicate with. In particular, the whole area of the metal cover section 11$a_2$ and the metal sheet 12 is larger than the area of the antenna coil 21. Therefore, a large-loop magnetic field can be generated. Furthermore, when seen from outside the cover 11, the magnetic sheet 24 is located farther from the cover 11 than the position of the antenna coil 21. This configuration increases the inductance of the antenna coil 21, resulting in an improvement in antenna characteristics.

Figure 12A:
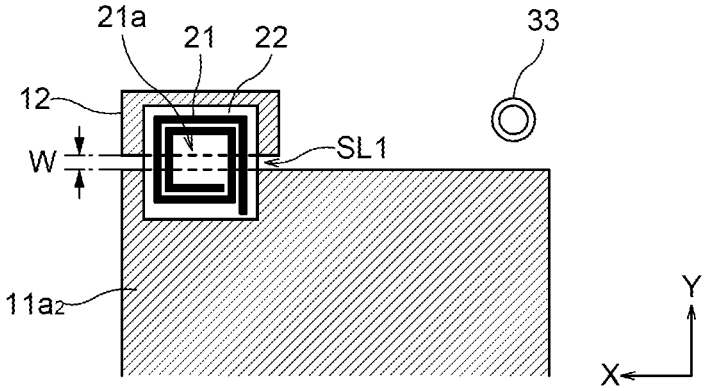
FIG. 12A is a schematic plan view showing an example of layout of the antenna coil 21.
Figure 12B:
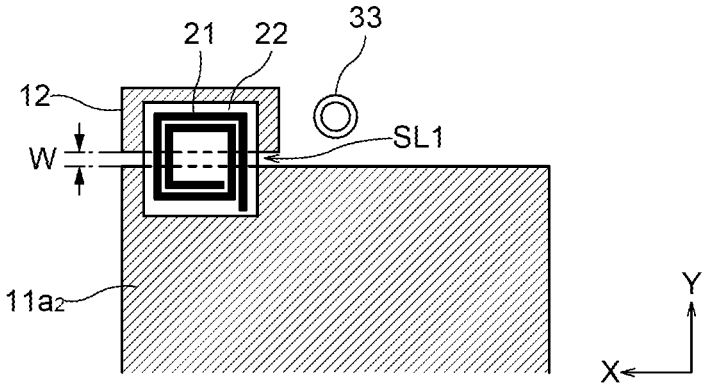
FIG. 12B is a schematic plan view showing an example of layout of the antenna coil 21.

FIGS. 12A and 12B are schematic plan views showing examples of layout of the antenna coil 21.

As shown in FIG. 12A, the antenna coil 21 is disposed in a width-direction left end portion, and the camera 33 is disposed in a width-direction right end portion. This configuration makes it possible to separate the mounting position of the antenna coil 21 from the camera 33, giving leeway for the layout of the antenna coil 21.

As shown in FIG. 12B, the antenna coil 21 is disposed in a width-direction left end portion, and the camera 33 is disposed in a width-direction central portion. This configuration makes it possible to place the camera 33 at the center, while the antenna coil 21 can be disposed in such a way as not to overlap with the camera 33.

According to the present embodiment, the housing itself does not have to have the slit SL1, helping to improve the degree of freedom in the design of the housing.

Figure 13A:
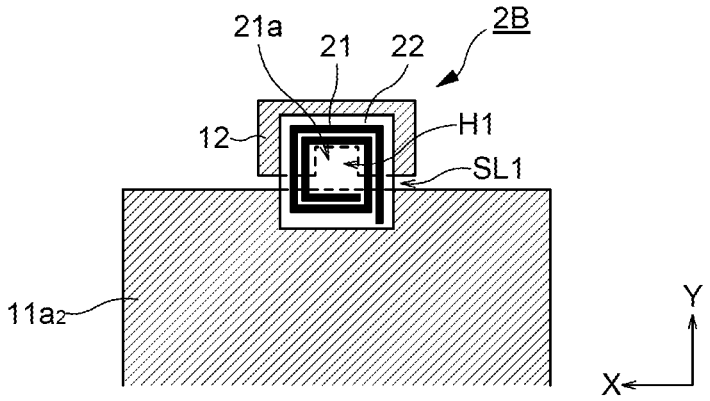
FIG. 13A is a schematic front view showing the configuration of an antenna device according to a seventh embodiment of the present invention.
Figure 13B:
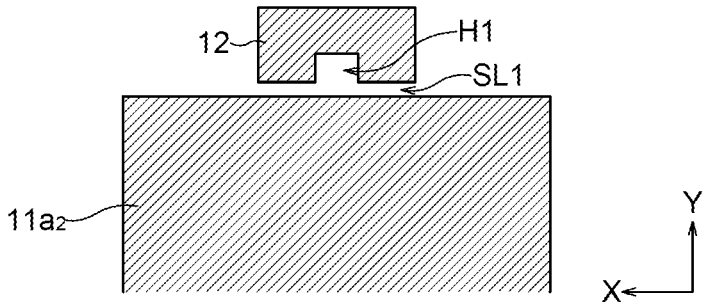
FIG. 13B is a schematic front view showing the configuration of the antenna device according to the seventh embodiment of the present invention and shows the situation where an antenna coil 21 is removed from that shown in FIG. 13A.
Figure 13C:
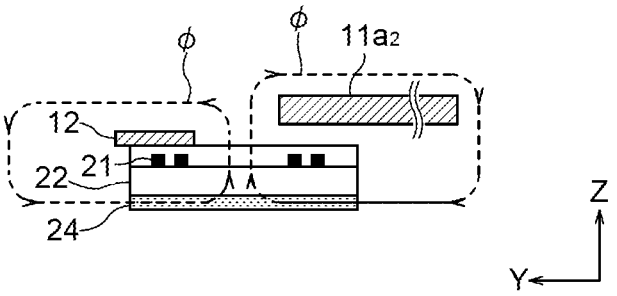
FIG. 13C is a schematic side cross-sectional view showing the configuration of the antenna device according to the seventh embodiment of the present invention.

FIGS. 13A to 13C are diagrams showing the configuration of an antenna device according to a seventh embodiment of the present invention. FIGS. 13A and 13B are schematic front views. FIG. 13C is a schematic side cross-sectional view. FIG. 13B shows the situation where an antenna coil 21 is removed from that shown in FIG. 13A.

As shown in FIGS. 13A to 13C, an antenna device 2B of the present embodiment is characterized in that the planar shape of a metal sheet 12 is not rectangular and has a concave pattern. Therefore, in a portion that overlaps with an inner diameter section of an antenna coil 21, an opening H1 that is wider than a slit SL1 can be formed. The rest of the configuration is the same as that of the sixth embodiment.

In the antenna device 2B of the present embodiment, a metal cover section 11$a$7 (first metal member) and a metal sheet 12 (second metal member) makes a large loop of the magnetic flux of the antenna coil 21. Therefore, the communication distance from the antenna device to an antenna that the antenna device will communicate with becomes longer. Moreover, in the antenna device 2B, the antenna coil 21 is placed in such a way as to overlap with the slit SL1 located between the metal cover section 11$a_2$ and the metal sheet 12 in planar view. Therefore, it is possible to improve the degree of freedom in the layout of the antenna coil 21. Furthermore, the opening H1 is located in such a way as to overlap with the inner diameter section of the diameter coil 21. Therefore, the passage area of magnetic flux φ can be widened.

Figure 14A:
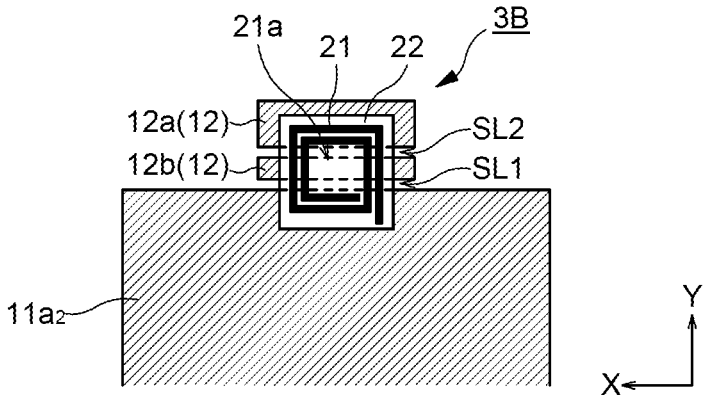
FIG. 14A is a schematic front view showing the configuration of an antenna device according to an eighth embodiment of the present invention.
Figure 14B:
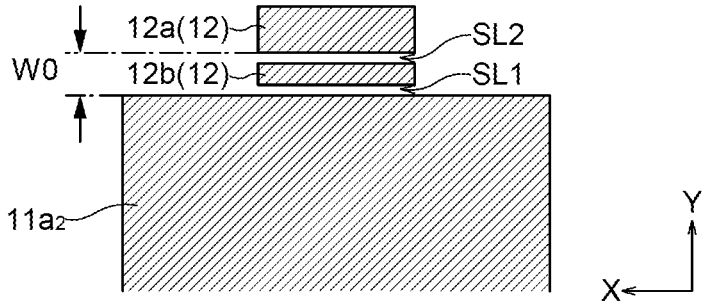
FIG. 14B is a schematic front view showing the configuration of the antenna device according to the eighth embodiment of the present invention and shows the situation where an antenna coil 21 is removed from that shown in FIG. 14A.
Figure 14C:
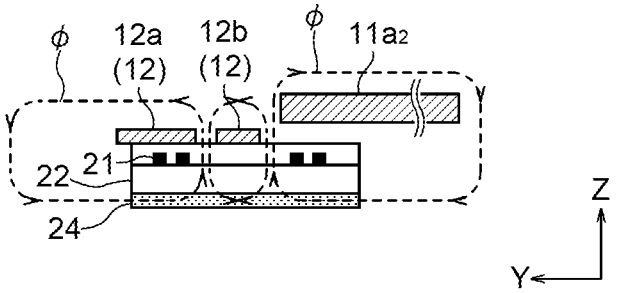
FIG. 14C is a schematic side cross-sectional view showing the configuration of the antenna device according to the eighth embodiment of the present invention.

FIGS. 14A to 14C are diagrams showing the configuration of an antenna device according to an eighth embodiment of the present invention. FIGS. 14A and 14B are schematic front views. FIG. 14C is a schematic side cross-sectional view. FIG. 14B shows the situation where an antenna coil 21 is removed from that shown in FIG. 14A.

As shown in FIGS. 14A to 14C, an antenna device 3B of the present embodiment is characterized in that a slit SL2 is formed in a metal sheet 12, and that an inner diameter section 21$a$ of an antenna coil 21 therefore overlaps with two slits SL1 and SL2 in planar view. The rest of the configuration is the same as that of the sixth embodiment. Although not specifically limited, it is preferred that the two slits SL1 and SL2 be equal in width.

In order to form the additional slit SL2, the metal sheet 12 is divided into a first metal sheet section 12$a$ and a second metal sheet section 12$b$. The second metal sheet section 12$b$ has an elongated linear shape that is parallel to the slits SL1 and SL2. The second metal sheet section 12$b$ is preferably larger in width than the slits SL1 and SL2. However, if the second metal sheet section 12$b$ is too large in width, it is impossible that the slits SL1 and SL2 are placed within the inner diameter section of the antenna coil 21. Therefore, the width of the second metal sheet section 12$b$ needs to be set appropriately. The width W0 from the slit SL1 to the slit SL2 needs to be narrower than the inner diameter section 21$a$ of the antenna coil 21.

The advantage of the antenna device 3B of the present embodiment is equal to or greater than the advantage of the antenna device 1B of the sixth embodiment. That is, a combination of the metal cover section 11$a_7$ and the metal sheet 12 makes a large loop of the magnetic flux of the antenna coil 21. Therefore, the communication distance from the antenna device to an antenna that the antenna device will communicate with becomes longer. Especially when two slits are provided, the communication distance of the antenna coil is longer than when one slit is provided. Moreover, the antenna coil 21 is placed in such a way as to overlap with the slits SL1 and SL2 in planar view, and, in particular, the slits SL1 and SL2 cross over the inner diameter section 21$a$ of the antenna coil 21. Therefore, the antenna coil 21 can be placed in any location in the direction in which the slits SL1 and SL2 extend, leading to an increase in the degree of freedom in the layout of the antenna coil 21.

Figure 15A:
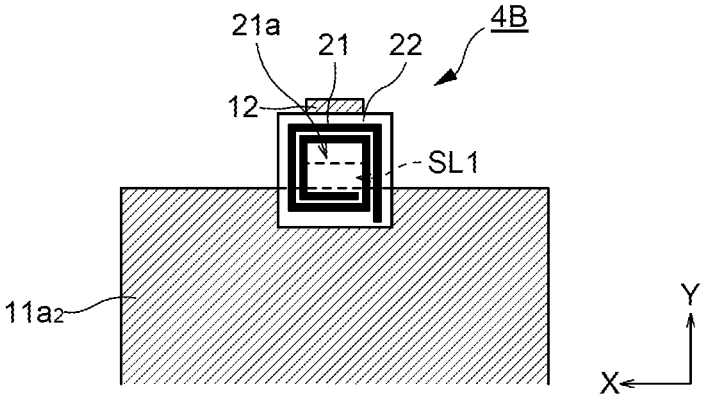
FIG. 15A is a schematic front view showing the configuration of an antenna device according to a ninth embodiment of the present invention.
Figure 15B:
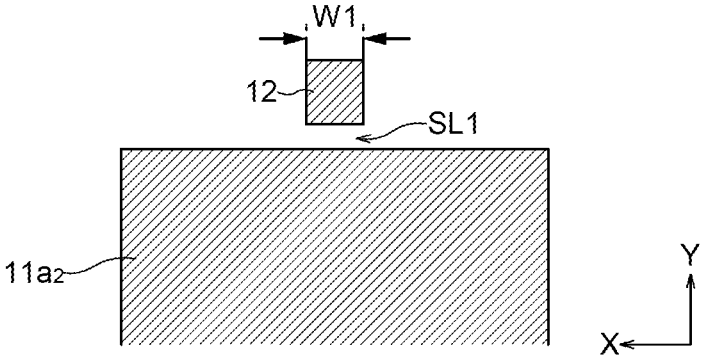
FIG. 15B is a schematic front view showing the configuration of the antenna device according to the ninth embodiment of the present invention and shows the situation where an antenna coil 21 is removed from that shown in FIG. 15A.
Figure 15C:
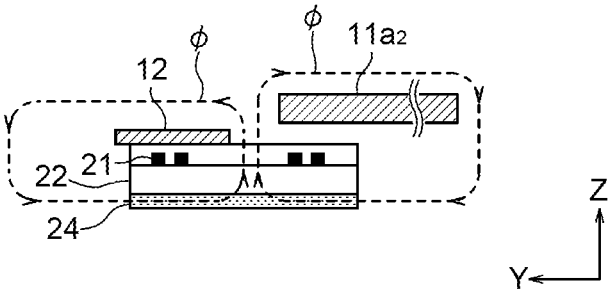
FIG. 15C is a schematic side cross-sectional view showing the configuration of the antenna device according to the ninth embodiment of the present invention.

FIGS. 15A to 15C are diagrams showing the configuration of an antenna device according to a ninth embodiment of the present invention. FIGS. 15A and 15B are schematic front views. FIG. 15C is a schematic side cross-sectional view. FIG. 15B shows the situation where an antenna coil 21 is removed from that shown in FIG. 15A.

As shown in FIGS. 15A to 15C, an antenna device 4B of the present embodiment is characterized in that the horizontal width W1 of a metal sheet 12 that is parallel to a slit SL1 is so set as to be substantially equal to the width of an inner diameter section of an antenna coil 21. The rest of the configuration is the same as that of the sixth embodiment. If the horizontal width W1 of the metal sheet 12 is substantially equal to the width of the inner diameter section of the antenna coil 21, the metal sheet 12 can be provided only in a region with which the magnetic flux of the antenna coil 21 is interlinked. The coil pattern does not overlap with the metal sheet 12 more than necessary. Therefore, it is possible to reduce the loss of magnetic flux and increase the communication distance.

Figure 16A:
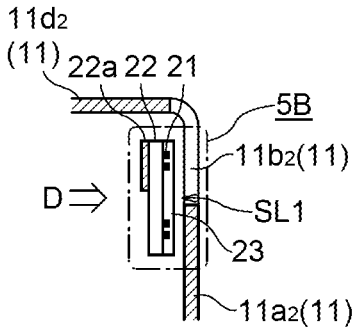
FIG. 16A is a schematic side cross-sectional view showing the configuration of an antenna device according to a tenth embodiment of the present invention.
Figure 16B:
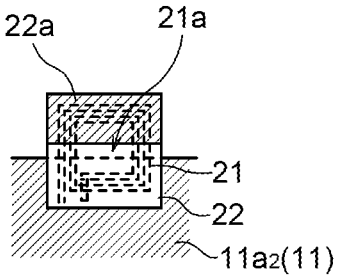
FIG. 16B is a schematic rear view showing the configuration of the antenna device according to the tenth embodiment of the present invention when seen in the direction of arrow D of FIG. 16A.

FIGS. 16A and 16B are diagrams showing the configuration of an antenna device according to a tenth embodiment of the present invention. FIG. 16A is a schematic side cross-sectional view. FIG. 16B is a schematic rear view of the antenna device when seen in the direction of arrow D of FIG. 16A.

As shown in FIGS. 16A and 16B, an antenna device 5B of the present embodiment is characterized in that, instead of the metal sheet 12, a metal layer 22$a$, which is formed on a back surface of a flexible substrate 22, is provided. Between a metal cover section $11a_2$ and the metal layer 22*a*, a slit SL1 is formed. The rest of the configuration is the same as that of the sixth embodiment.

Although not specifically limited, the metal layer 22*a* may be formed in the same way as the antenna coil 21 is formed on the flexible substrate 22. The metal layer 22*a* can be formed by patterning of a metal layer that is formed in advance on the entire back surface of the flexible substrate 22. Even when the metal layer 22*a* is provided on the back surface of the flexible substrate 22, it is possible to achieve the same advantageous effect as the first embodiment. Furthermore, since the metal layer on the flexible substrate 22 is used, there is no need to add a metal sheet. In this manner, the metal member on the antenna coil 21 side can be easily and reliably formed.

Figure 17A:
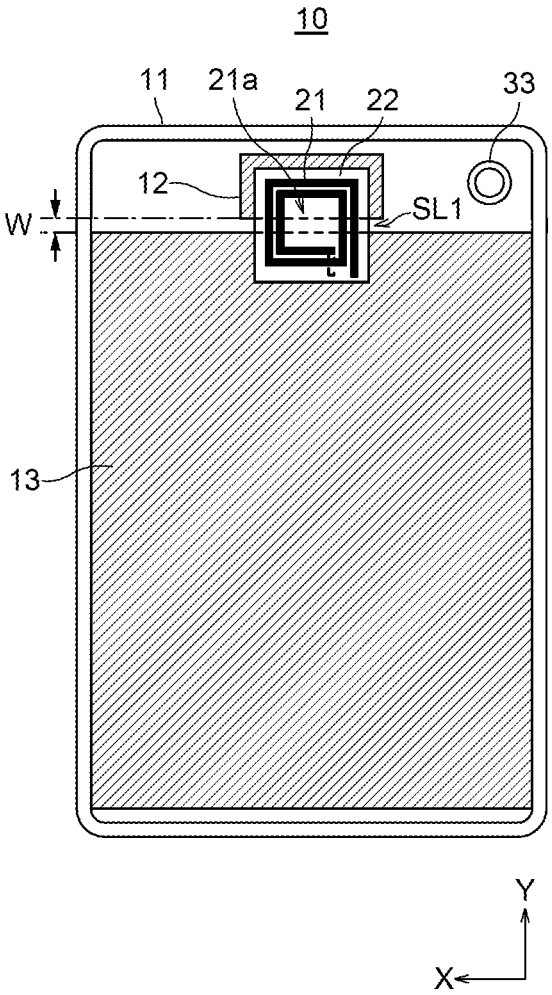
FIG. 17A is a schematic front cross-sectional view showing the configuration of a portable electronic device including an antenna device according to an eleventh embodiment of the present invention.
Figure 17B:
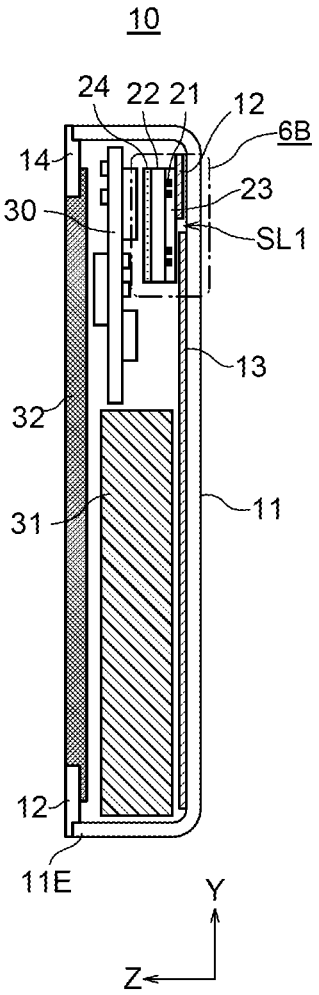
FIG. 17B is a schematic side cross-sectional view showing the configuration of the portable electronic device including the antenna device according to the eleventh embodiment of the present invention.

FIGS. 17A and 17B are diagrams showing the configuration of a portable electronic device including an antenna device of an eleventh embodiment of the present invention. FIG. 17A is a schematic front cross-sectional view. FIG. 17B is a schematic side cross-sectional view.

As shown in FIGS. 17A and 17B, an antenna device 6B is characterized in that a cover 11 is made of insulating resin, and that a metal film 13 is formed on the back surface of the cover 11. The cover 11 makes up the opposite main surface (back surface) and four side surfaces of the portable electronic device 10. The metal film 13 covers a majority of the main surface of the cover 11 over a wide range. The metal film 13 is substantially part of the housing. The rest of the configuration is the same as that of the sixth embodiment.

An antenna coil 21 is placed in such a way as to partially overlap with an upper end portion of the metal film 13. An almost lower half of the antenna coil 21 overlaps with the metal film 13 in planar view. Meanwhile, an almost upper half of the antenna coil 21 does not overlap with the metal film 13 in planar view. Between the almost upper half of the antenna coil 21 and the cover 11, a metal sheet 12 is provided. Between the metal film 13 (first metal member) and the metal sheet 12 (second metal member), a slit SL1 of a constant width is formed in such a way as to extend in the width direction of the portable electronic device 10. An up-down-direction central area of the antenna coil 21 is a region that does not overlap with the metal film 13 and the metal sheet 12. The metal sheet 12 and the metal film 13 are electrically insulated from each other by the slit SL1.

The antenna device 6B of the present embodiment can achieve the same advantageous effect as the antenna device 1B of the sixth embodiment. That is, the metal film 13 (first metal member) and the metal sheet 12 (second metal member) makes a large loop of the magnetic flux of the antenna coil 21. Therefore, the communication distance from the antenna device to an antenna that the antenna device will communicate with becomes longer. Moreover, in the antenna device 6B, the antenna coil 21 is placed in such a way as to overlap with the slit SL1 located between the metal film 13 and the metal sheet 12 in planar view. Therefore, it is possible to increase the degree of freedom in the layout of the antenna coil 21.

Figure 18A:
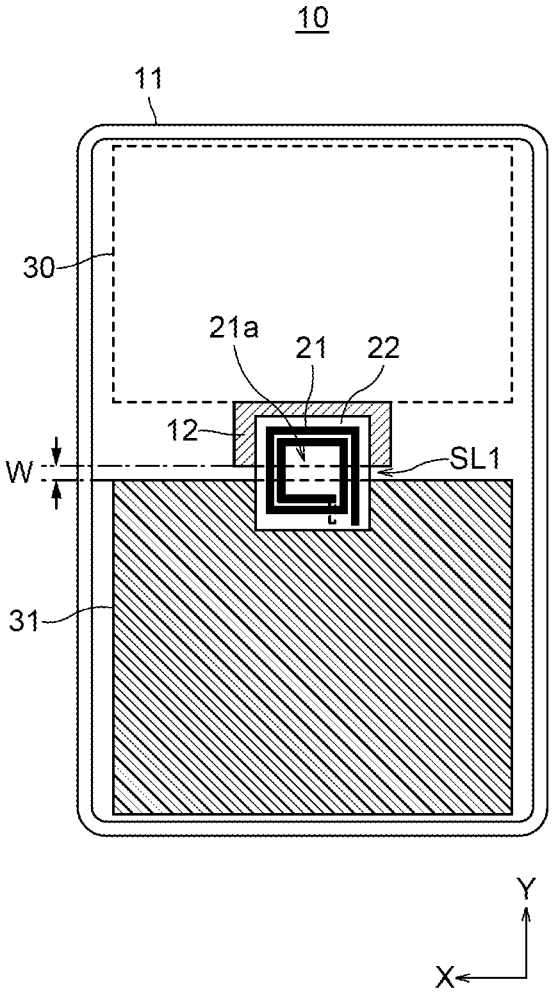
FIG. 18A is a schematic front cross-sectional view showing the configuration of a portable electronic device including an antenna device according to a twelfth embodiment of the present invention.
Figure 18B:
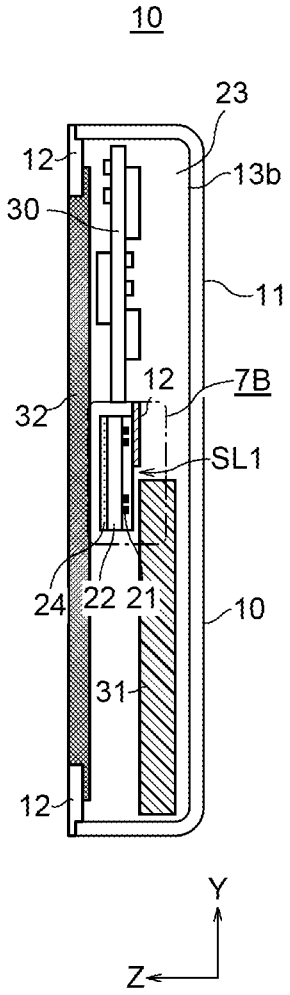
FIG. 18B is a schematic side cross-sectional view showing the configuration of the portable electronic device including the antenna device according to the twelfth embodiment of the present invention.

FIGS. 18A and 18B are diagrams showing the configuration of a portable electronic device including an antenna device of a twelfth embodiment of the present invention. FIG. 18A is a schematic front cross-sectional view. FIG. 18B is a schematic side cross-sectional view.

As shown in FIGS. 18A and 18B, an antenna device 7B is characterized in that a cover 11 is made of insulating resin, and that a slit SL1 is formed by a combination of a metal sheet 12, which is fixed to an antenna coil 21, and a metal casing of a battery pack 31. Accordingly, the antenna coil 21 is disposed at almost center of a longitudinal direction of a portable electronic device 10 in such a way as to partially overlap with the battery pack 31 in planar view. A main surface of the metal sheet 12 is parallel to a main surface of the battery pack 31. The rest of the configuration is the same as that of the sixth embodiment.

An antenna coil 21 is placed in such a way as to partially overlap with an upper end portion of the battery pack 31. An almost lower half of the antenna coil 21 overlaps with the battery pack 31 in planar view. Meanwhile, an almost upper half of the antenna coil 21 does not overlap with the battery pack 31 in planar view. Between the almost upper half of the antenna coil 21 and the cover 11, a metal sheet 12 is provided. Between the battery pack 31 (first metal member) and the metal sheet 12 (second metal member), a slit SL1 of a constant width is formed in such a way as to extend in the width direction of the portable electronic device 10. An up-down-direction central area of the antenna coil 21 is a region that does not overlap with the battery pack 31 and the metal sheet 12. The metal sheet 12 and the battery pack 31 are electrically insulated from each other by the slit SL1.

According to the present embodiment, it is possible to achieve the same advantageous effect as the sixth embodiment. That is, in the antenna device 7B of the present embodiment, the battery pack 31 (first metal member) and the metal sheet 12 (second metal member) makes a large loop of the magnetic flux of the antenna coil 21. Therefore, the communication distance from the antenna device to an antenna that the antenna device will communicate with becomes longer. Moreover, in the antenna device 7B, the antenna coil 21 is placed in such a way as to overlap with the slit SL1 located between the battery pack 31 and the metal sheet 12 in planar view. Therefore, it is possible to increase the degree of freedom in the layout of the antenna coil 21.

It is apparent that the present invention is not limited to the above embodiments, but may be modified and changed without departing from the scope and spirit of the invention.

Figure 19:
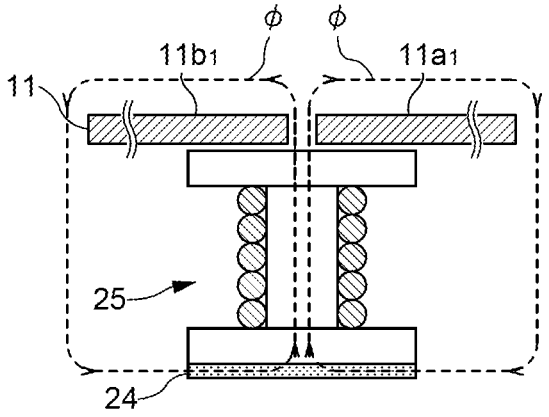
FIG. 19 is a schematic side cross-sectional view showing the configuration of an antenna device according to a modified embodiment of the present invention.
Figure 20:
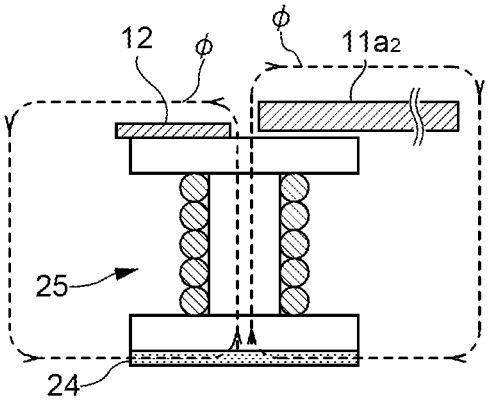
FIG. 20 is a schematic side cross-sectional view showing the configuration of an antenna device according to a modified embodiment of the present invention.
Figure 21A:
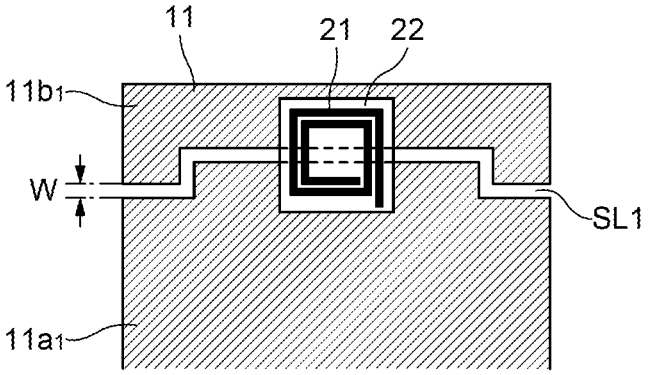
FIG. 21A is a schematic plan view showing the configuration of an antenna device according to a modified embodiment of the present invention and shows an example of the shape of a slit.
Figure 21B:
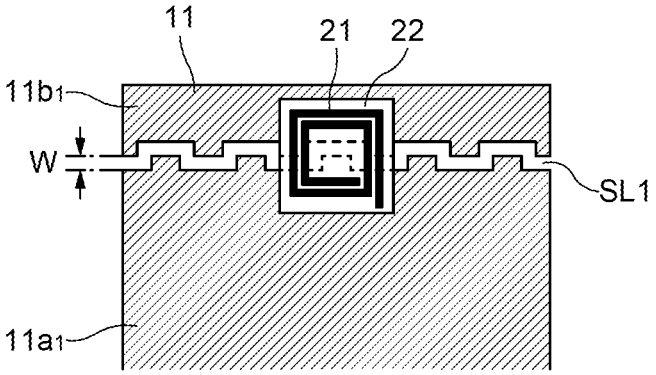
FIG. 21B is a schematic plan view showing the configuration of an antenna device according to a modified embodiment of the present invention and shows an example of the shape of a slit.
Figure 21C:
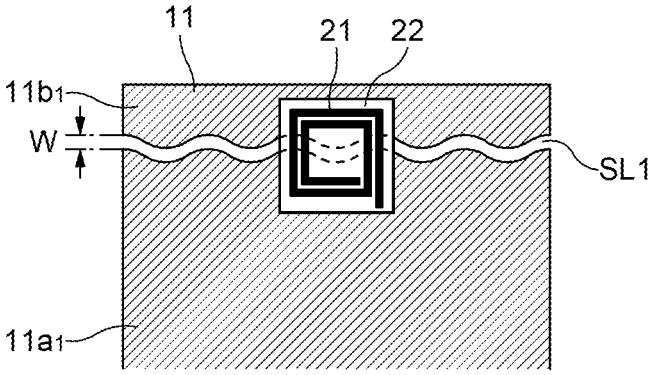
FIG. 21C is a schematic plan view showing the configuration of an antenna device according to a modified embodiment of the present invention and shows an example of the shape of a slit.

For example, in the above-described embodiments, as an antenna coil, a planar coil is used. However, the present invention is not limited to the planar coil. For example, as shown in FIG. 19 or 20, an antenna coil 25 of a winding type may be used. In the case of the first to fifth embodiments, a straight slit that is completely straight is described as an example. However, the present invention is not limited to this. For example, a bent pattern may be used as shown in FIG. 21A, or a comb-teeth pattern may be used as shown in FIG. 21B, or a waveform pattern may be used as shown in FIG. 21C. Furthermore, in the above-described embodiments, the antenna coil faces outward when seen from the flexible substrate. Instead, the antenna coil may be mounted in such a way as to face inward. It is also possible to combine each of the embodiments.

In the above-described embodiments, the main circuit board is placed in such a way as to overlap with the antenna coil in planar view. Alternatively, the battery pack may be provided in such a way as to overlap with the antenna coil in planar view.

What is claimed is:

1. An antenna device comprising:

a first metal member having a first main surface;

a second metal member having a second main surface parallel to the first main surface; and an antenna coil having a coil axis perpendicular to the first and second main surfaces, wherein the second metal member is fixed to the antenna coil, at least one slit is formed between the first and second metal members, an inner diameter section of the antenna coil overlaps with the slit in planar view, and wherein material of the second metal member is different from material of the first metal member.

2. The antenna device as claimed in claim 1, wherein an opening that overlaps with the slit is further provided between the first and second metal members, and the inner diameter section of the antenna coil overlaps with the opening in planar view.

3. The antenna device as claimed in claim 1, wherein the first metal member is a metal cover section that constitutes at least a part of a housing of a portable electronic device in which the antenna coil is mounted.

4. The antenna device as claimed in claim 1, wherein the first metal member is a battery pack of a portable electronic device in which the antenna coil is mounted.

5. The antenna device as claimed in claim 1, further comprising a cover composed of insulating resin, wherein the first metal member is composed of a metal film formed on a surface of the cover.

6. The antenna device as claimed in claim 1, further comprising a magnetic sheet that is located farther than the antenna coil when seen from the first metal member and is fixed to the antenna coil.

7. A portable electronic device comprising:

a housing;

a circuit board provided in the housing; and an antenna device provided in the housing along with the circuit board, wherein the antenna device includes:

a first metal member having a first main surface;

a second metal member having a second main surface parallel to the first main surface; and an antenna coil having a coil axis perpendicular to the first and second main surfaces, the second metal member is fixed to the antenna coil, at least one slit is formed between the first and second metal members, and an inner diameter section of the antenna coil overlaps with the slit in planar view, and wherein the material of the second metal member if different from the material of the first metal member.

* * * * *